United States Patent [19]

Murphy et al.

[11] 4,315,576

[45] Feb. 16, 1982

[54] CHILD RESISTANT CLOSURE CAP APPARATUS EMPLOYING FULCRUM ACTION

[75] Inventors: Joseph E. Murphy, Basking Ridge; Frank Piceno, Jr., Minehill, both of N.J.

[73] Assignee: Gilbert Plastics, Inc., Somerset, N.J.

[21] Appl. No.: 158,830

[22] Filed: Jun. 12, 1980

[51] Int. Cl.[3] ..... B65D 41/18

[52] U.S. Cl. ..... 220/282; 220/85 P; 220/306; 222/153; 222/182

[58] Field of Search ..... 220/281, 282, 283, 306, 220/85 P; 222/153, 182

[56] References Cited

U.S. PATENT DOCUMENTS

| | | | |
|---|---|---|---|
| 2,379,679 | 7/1945 | Burdick | 220/282 |
| 3,089,608 | 5/1963 | Burdick et al. | 220/282 |
| 3,885,715 | 5/1975 | Lowry | 222/182 |
| 3,995,766 | 12/1976 | Fralick | 220/282 |

FOREIGN PATENT DOCUMENTS

| | | | |
|---|---|---|---|
| 6613210 | 4/1967 | Netherlands | 220/282 |

*Primary Examiner*—George E. Lowrance
*Attorney, Agent, or Firm*—Arthur L. Plevy

[57] ABSTRACT

A child resistant closure cap is detachably fastened over a peripheral flange associated with a container. The cap has a peripheral bottom flange upon which is located a plurality of fulcrum members which rest upon the top edge of the container flange. Located beneath a selected number of fulcrum members is a projecting undercut, which undercut as positioned underlies the container flange. One of the undercuts is not associated with a fulcrum member and above this undercut, a force is applied by a user to cause the cap to pivot about the fulcrums releasing the same from the container.

10 Claims, 5 Drawing Figures

CHILD RESISTANT CLOSURE CAP APPARATUS EMPLOYING FULCRUM ACTION

BACKGROUND OF THE INVENTION

This invention relates to a child resistant closure cap for selectively gaining acess to a container and more particularly to a child resistant overcap for an aerosol or similar type of can.

It is a well known problem that serious health damage can occur to young children who have a tendency to play with various containers found in a typical household. Such containers may, by way of example, contain pharmaceutical preparations and in the case of aerosol containers, may dispense a fine spray of insecticide, paint and other chemicals which can severely injure the child. The problem is extremely serious and has been recognized in legislation entitled "The Poison Prevention Packaging Act," which Act was enacted in 1970. This Act recognizes that there is a direct need to protect young children from such injuries and to therefore place a duty upon a manufacturer to include in the design of a container carrying such substances, a child resistant or child proof closure.

The prior art is extremely cognizant of the problem and a plethora of patents exist which attempt to solve this problem in many ways. In view of such references, it is beyond a doubt that there is a recognized need for such safety packaging to prevent injuries to children. The prior art discloses a number of various devices, which devices purport to do so and which devices operate to discourage or prevent the child from inadvertently opening a container which houses a deleterious substance. As one can ascertain from viewing the prior art, there are various and diverse techniques for implementing such structure.

Patents such as U.S. Pat. No. 3,610,454 entitled SAFETY CONTAINER AND CLOSURE STRUCTURES issued on Oct. 5, 1971 to D. M. Malick discloses a safety device which operates to latch a cap to a bottle or container so that normal rotation of the cap will not cause it to be removed from the bottle. In accordance with this structure, the cap contains holding means which are forced between the threads of the bottle and by application of a force to the top of the cap, the holding means are dislodged to enable the threads to properly engage and to therefore permit one to remove the cap.

U.S. Pat. No. 3,782,574 entitled TAMPERPROOF CLOSURE FOR CONTAINERS issued on Jan. 1, 1974 to R. W. Rumble depicts a locking device where a cap contains a number of projections and can be emplaced upon a container which has coacting slots on the surface. The apparatus enables removal of the cap at only one particular orientation and hence, tends to discourage a child from inadvertent removal.

Other patents as U.S. Pat. No. 3,794,200 issued to W. J. Marks on Feb. 26, 1974 entitled SAFETY CLOSURE AND PACKAGING depict a cap which can be pressed down upon to lock it to a container. It will freely rotate, but cannot be removed. By selectively rotating the cap to a predetermined position, one can release the cap assembly from the container.

U.S. Pat. No. 3,802,607, entitled CHILD RESISTANT OVERCAP FOR AEROSOL OR LIKE CONTAINERS issued on Apr. 9, 1974 to K. C. Mead discloses a locking device for an aerosol container. A cap designated as an overcap has an inner shell and an outer shell, which outer shell is capable of being distorted by exerting a pressure to the same. The inner and outer shells are coaxially arranged and are connected together by aligned webs or struts. The inner shell has locking means which engage a flange associated with the container and by the application of a force applied to the outer shell, it is transmitted via the struts to distort the inner shell and cause a release of the locking mechanisms.

Other patents as U.S. Pat. No. 3,866,802 also depict locking means for aerosol containers and enable disengagement of the cap from the container by an axial motion followed successively by a rotative motion of the cap relative to the locking mechanisms.

U.S. Pat. No. 3,980,194 shows a safety container which requires a selective tilting when a cap is aligned with the container and an upward force is exerted to the cap.

Essentially, these are but a few of the references which exist in the prior art and which all attempt to provide a safety closure for a container to thereby prevent young children from inadvertently gaining access to the contents. It is clear that the above devices are quite diverse and operate on various principles such as selective rotation and alignment or the exertion of predetermined force at a particular point. It is further clear that certain of these devices, especially those relating to aerosol containers, are extremely complicated and difficult to manufacture due to their composite structure such as containing inner and outer shell mechanisms. Such devices are integrally formed by a plastic molding technique and hence, devices as those depicted in U.S. Pat. Nos. 3,866,802 and 3,802,607 require relatively complicated molds and utilize a relatively large amount of raw material, such as a suitable plastic.

The common feature between many of the structures depicted above and others existing in the prior art is the complicated structure and hence, such structures require considerable expenses and difficulties in implementing the manufacture of such containers and caps. It is also apparent that many of the devices depicted in the prior art are extremely difficult to open, both from a child's point of view as well as an adult's point of view and hence, many such structures have never been employed commercially.

It is therefore an object of the present invention to provide an improved child resistant closure cap, which cap is economical to manufacture, while providing an extreme deterrent against the inadvertent opening of the same by a child. The cap to be described is particularly adaptable to be emplaced and employed with an aerosol container, although other containers such as bottles and so on can be used together with the structure. It is a prime intent of the present cap structure to utilize a common container configuration, which container requires little or no modification to accommodate the cap structure according to this invention.

BRIEF DESCRIPTION OF THE PREFERRED EMBODIMENT

A child resistant closure cap apparatus for covering a container having a top peripheral flange surrounding the same at a substance removal end; wherein said closure cap comprises a relatively hollow cup shaped member having a closed top surface and an opened bottom, said cup shaped member having a plurality of fulcrum members located about the inner peripheral wall of said cup member and adapted to coact with the top surface of said flange when said cap is emplaced upon said container, a plurality of undercut projections each associated with and located beneath one of said fulcrum members and positioned below said flange when said cap is emplaced, with an additional undercut projection positioned between at least two of said fulcrum members and located in the same plane as said other projections, with said projections operating to secure said cap when emplaced upon said container, with said additional undercut members adapted to receive a force imparted above the same to the closed top surface of said cup member to cause at least two of said fulcrum members to respond to said force to pivot said undercut projections away from said flange to enable removal of said cap from said container upon application of said force to said top surface of said cup shaped cap member.

DETAILED DESCRIPTION OF THE INVENTION

Figure 1:
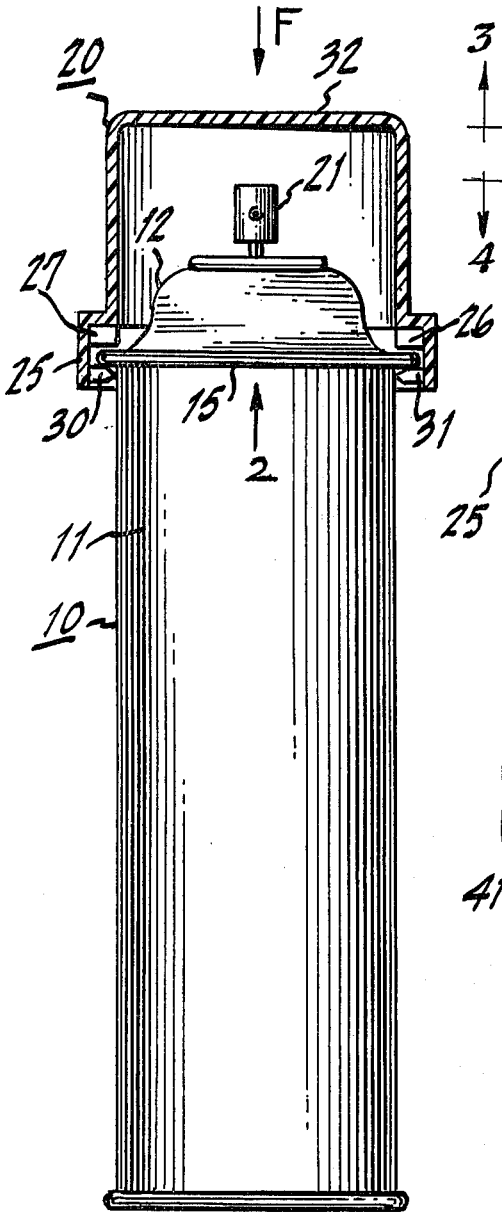
FIG. 1 is a front plan view of the closure cap partially in cross section illustrating the affixation of the cap to an aerosol container.

Referring to FIG. 1 there is shown a typical example of an aerosol spray can or container 10 to which a cup shaped closure cap 20 according to this invention is secured. The container assembly includes a longitudinal cylindrical body portion 11 which is fabricated from a metal. A top portion 12 is of a dome shaped structure and normally secured to the body portion 11 by a suitable metal work process, such as crimping, soldering, welding or some other suitable process. In such a process, a peripheral extending flange 15 is formed between the domed portion 12 and the body portion 11. This peripheral flange 15 is typically formed in an aerosol container and such a flange as 15 exists in many other container configurations.

The contents of the container 10 are held within the body portion 11 under pressure and a finger operated spray nozzle assembly 21 is secured to the domed portion. The nozzle assembly 21 is operated by depressing the same in a downward direction or by actuating a typical valve bonnet to discharge the contents as desired. The operation and formation of such aerosol containers are well known in the art and many contain a wide variety of substances.

The closure cap 20 is fabricated from a suitable plastic and contains at predetermined locations about an extending lower peripheral flange 25, a series of fulcrum members as 26 and 27. A fulcrum member as 26 and 27 possesses a sharp apex which rests upon or is in close proximity to the top portion of the flange 15. Beneath each fulcrum member, there is located an undercut projection 30 and 31, which undercut member is positioned beneath the lower edge of the flange 15. Hence, as can be seen from FIG. 1, when the cap 20 is emplaced upon the flange, the undercut projections 30 and 31 prevent one from removing the cap from the can.

It is understood, of course, that the cap 20 as fabricated from a suitable plastic is somewhat elastomeric or flexible. The undercut projections 30 and 31 as well as the fulcrum members 26 and 27 are integrally formed with the cap assembly and hence, are fabricated from the same type of plastic.

Due to the structure of the undercut members 30 and 31 by exertion of a proper force, as will be explained, and by the pressure amplification afforded by the fulcrum members 26 and 27, the undercut members can be released from the peripheral flange 15 and hence the cap 20 can be removed by the application of a directional pressure at a predetermined area applied to the top surface 32 of the cap 20.

It is seen from FIG. 1 that the outward appearance of the cap 20 is extremely coventional, as many of the available various types of cans or containers 10 have overcaps as 20 which appear similar from an outward appearance. Thus, the cup shaped cap 20 appears as a conventional cap with the locking operation, as above described, determined by the position of the fulcrum members in relation to the undercut projections.

Figure 2:
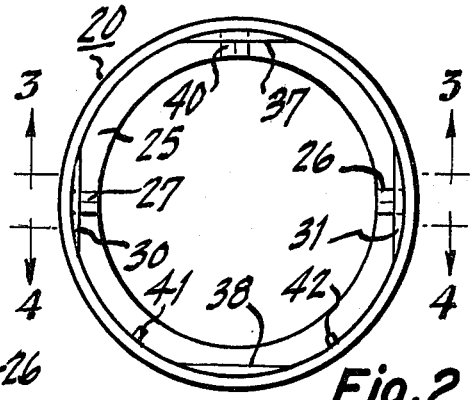
FIG. 2 is a bottom plan view of the cap according to this invention.

Referring to FIG. 2, there is shown a bottom plan view of the overcap 20 viewed from the direction depicted by arrow 2 of FIG. 1. Essentially. the overcap 20, as indicated, is circular in configuration and contains an extending bottom peripheral flange 25. Positioned about the periphery of the flange 25 are four undercut members as 30 and 31 of FIG. 1 and the additional members 37 and 38. These members, as will be explained, are located on the outer wall of the flange 25. Positioned above members 30,31 are the fulcrum members as 26 and 27 of FIG. 1 and fulcrum member 40, which member is associated with the projecting undercut member 37.

It can be seen from FIG. 2 that there is no fulcrum member associated with the undercut 38, but located on each side of the undercut 38 are two destructible strut members 41 and 42. The purpose and function of the destructible strut members, as will be further explained, is to provide peripheral support for the cap 20 during storage of the container, such as in a warehouse or within a shipping carton containing many containers.

As can be seen from FIGS. 1 and 2, when the cap is placed upon the container 10, the fulcrum members as 26, 27 and 40 rest upon the top surface of the peripheral flange 15. The undercut members 30,31,37 and 38 are positioned at the underside of the flange 15 and hence, prevent the cap from being removed. Since the undercut 38 is not associated with a fulcrum, the struts 41 and 42 which extend from the inner surface of the flange 15 in the same manner as do the fulcrum members, provide peripheral support to the cap about the undercut projection 38. In this manner, if a uniform force were applied to the surface 32 of the overcap 20, the cap would not pivot and hence, a uniform supporting surface would be provided to allow cans to be stacked one above the other or to accommodate for the typical forces which occur during shipping or storage.

Figure 3:
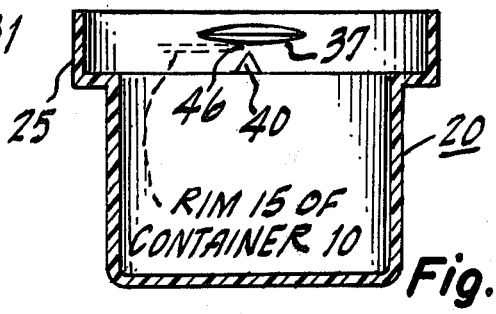
FIG. 3 is a partial sectional view taken through line 3—3 of FIG. 2.

Referring to FIG. 3, there is shown a partial cross sectional view taken through line 3—3 of FIG. 2 which is useful to show the structure of the fulcrum member 40 in relation to the associated undercut member 37.

As can be seen from FIG. 3, the fulcrum member 40 is integrally formed and extends from the back wall of the flange 25. The member 40 is triangular in shape and has a sharp point or apex 46 which, as shown in FIG. 1, rests upon the outer surface of the peripheral flange 15. The undercut 37 is an elongated projection of a tapered cross section and is positioned beneath the apex 46 of the fulcrum member 40 and rests, as indicated in FIG. 1, beneath the bottom surface of the flange 15.

Again, referring to FIG. 2, is it noted that the center of the four undercuts are positioned about the periphery of the cap at approximately ninety degree intervals. The two fulcrum members 26 and 27 are located opposite one another, but are slightly offset from the true diameter of the cap and hence, are offset about 0.5 to 2 degrees. This offset appears to provide a more efficient fulcrum operation for the relatively sharp apexes associated with the fulcrum members. The slight offset is directed towards the undercut 38 above which, as will be explained, a force is applied by the user to the top surface of the cap 20 to cause the cap to dislodge from the container.

Figure 4:
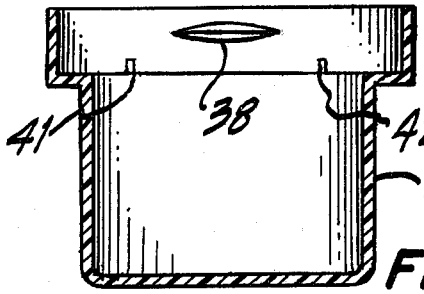
FIG. 4 is a partial sectional view taken through line 4—4 of FIG. 2.

Referring to FIG. 4, there is shown a partial cross sectional view taken through line 4—4 of FIG. 2 depicting the undercut member 38 positioned between the destructible strut members 41 and 42. The strut members 41 and 42 are much smaller in width than the base of the fulcrum member 40 and are positioned at the back wall of the flange 25 and as indicated, serve to provide support about the undercut member 38 for storage purposes.

Figure 5:
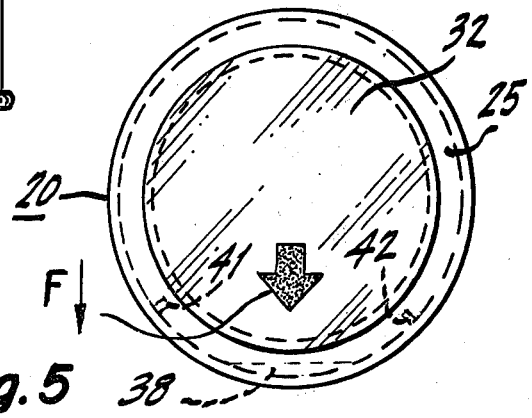
FIG. 5 is a top view depicting a cap according to this invention.

Referring to FIG. 5, there is shown a top view of the closure cap 20 with an arrow embossed or otherwise formed upon the top surface 32 of the cap 20. The arrow or indicating means is positioned relatively centrally and above the location of the undercut member 38 and this arrow serves to indicate to a user, the exact location to apply a downward force, which force, if applied at the location of the arrow on the top surface 32 of the cap 20, will cause the cap 20 to be removed from the can. The operation is as follows:

Upon application of a suitable force, such as a force imparted by the thumb or fingers of a user when grasping a can, the following action will occur. When the can is to be first opened, as indicated, the struts 41 and 42 coact the peripheral flange 15 and provide support about the undercut member 38 which is positioned beneath the bottom surface of the peripheral flange 15. Upon exertion of a force about the undercut 38, the struts 41 and 42 collapse or yield as they are extremely thin, as indicated. The collapsing or yielding of the struts causes the force imparted above the undercut 38 to be transmitted to the fulcrum members 26 and 27 as the cap 20 begins to arc in a downward direction. As indicated, the fulcrum members 26 and 27, being of a triangular configuration, exert a large pressure on the flange 15. This pressure, of course, is due to the fact that the apex as 46 of the fulcrum member constitutes an extremely small area and hence, the force causes a large pressure to be exerted. This pressure imparted by the fulcrum members causes the undercut members to flex and arc to remove the undercut members from the peripheral flange, thereby releasing the cap from the can.

The additional undercut 37 and its associated fulcrum 40 provides a restriction of the pivotal action to tend to confine the same to mainly occur about the fulcrums 26 and 27 and hence, assures that the cap will be removed. The destruction of the struts occurs, as indicated, during the first operation of cap removal and hence, a slightly greater force may be required when the cap is first removed from the can.

Thereafter, the cap is emplaced upon the can, as indicated. This will again cause the undercuts and the fulcrums to be positioned as described, with the exception that the struts 41 and 42 are permanently collapsed. In this event, the cap can only be removed by the same exact action as above described, but the amount of force required is slightly less than initially required. Based on the above described construction, it has been determined that the amount of force necessary to remove the cap from the can is strictly compatible with the capabilities and strength of a typical adult. Hence, a female adult who may not possess as much strength as a male, will have no difficulty in exerting enough force at the location designated by the arrow to remove the cap from the container. In any event, the necessary force to accomplish removal is not easily provided by a young child, especially by a child between the ages of a few months to five or more years. It is, of course, understood that the protection desired in regard to children of this age is of paramount importance as older children, for example, tend to exercise greater caution and are more likely to be aware of the consequences in the unauthorized use of such containers.

As one can ascertain, the cap structure depicted is extremely simple to implement from a manufacturing point of view as the fulcrum members as well as the struts and undercuts can be simply formed by a conventional plastic molding technique. The overcap can be fabricated from from many well known plastics which are conventionally employed in the prior art for such structures and hence, no new materials need be employed. For example, one can use polystyrene, polyethylene, polypropylene or an acetal resin such as those plastics sold under the trademark DELRIN. In this manner, the manufacturer need not train his employees in working with new materials.

It is further noted that the fulcrum structures need not be triangular in shape, but should present a relatively small surface area when coacting the flange 15 of the can in order to act as a pressure amplifier for concentrating the force exerted at the location of the arrow.

It is further understood that additional markings could be employed on the top surface of the cap 20 to further aid and assist the user in removing the cap, if necessary. Hence, the user may be instructed that upon exertion of a force at the arrow, he may then also attempt to pull the cap in an upward direction at the opposite end. This action will also facilitate removal of the cap.

As one can ascertain, the entire cap is preferably a unitary structure, but of course, the fulcrum members can be emplaced at suitable locations by the use of epoxy or suitable adhesives, if desired.

As indicated, the cap is particularly adapable to be employed with aerosol containers which, based on the inherent manufacturing procedures, possess the peripheral extended rim 15 as above described. In any event, it should be apparent that any container could be accommodated with such a flange and hence, the cap can be employed in other container configurations apart from aerosol containers.

It is therefore understood based on the above description that various alternate embodiments will be apparent to those skilled in the art and all such alterations as well as additional uses are deemed to be included within the scope and spirit of the claims appended hereto.

We claim:

1. A child resistant closure cap apparatus for covering a container having a top peripheral flange surrounding the same at a substance removal end, said closure cap comprising:

a relatively hollow cup shaped member having a closed top surface and an opened bottom, said cup shaped member having a plurality of fulcrum members located about the inner peripheral wall of said cup member and adapted to coact with the top surface of said flange when said cap is emplaced upon said container, a plurality of undercut projections each associated with and located beneath one of said fulcrum members and positioned below said flange when said cap is emplaced with each of said undercut projections having a tapered cross section being thickest near said peripheral wall and sloping downwardly beneath said flange to allow said undercut projection to flex upon application of an activating force, with an additional undercut projection positioned between at least two of said fulcrum members and located in the same plane as said other projections, with said projections operating to secure said cap when emplaced upon said container, with said additional undercut member adapted to receive a activating force imparted above the same to the closed top surface of said cup member to cause at least two of said fulcrum members to respond to said force to flex and pivot said undercut projections away from said flange to enable removal of said cap from said container upon application of said force to said top surface of said cup shaped cap.

2. The closure cap apparatus according to claim 1 wherein said fulcrum members possess a relatively small area apex for applying a relatively large pressure to said flange when said force is imparted to said top surface of said cup shaped member.

3. The closure cap apparatus according to claim 1 further comprising at least one strut member located adjacent said additional projection and adapted to provide support about said projection when said force is not imparted, said strut member configured to permanently collapse when said force is imparted.

4. The closure cap apparatus according to claim 1 wherein said plurality of fulcrum members include at least three members located at relatively ninety degree intervals with at least two members positioned opposite each other, each of said three members associated with one undercut projection, and said additional undercut projection located relatively centrally between said two opposite fulcrum members.

5. The closure cap apparatus according to claim 1 wherein said cup shaped member further includes an extending flange located about said bottom opening with said fulcrum members extending from the top of said flange towards said opening.

6. The closure cap apparatus according to claim 1 wherein said undercut projections are relatively elongated peripheral flanges having a tapered cross section to enable said projections to flex upon application of said force.

7. The closure cap apparatus according to claim 1 wherein said fulcrum members are triangular in shape having the apex of said triangle facing the top surface of said container flange.

8. The closure cap apparatus according to claim 1 further having indicia located on said top surface indicating the position of said additional undercut projection and therefore the area to which said force is to be applied.

9. The closure cap apparatus according to claim 1 wherein said cup shaped member is fabricated from plastic.

10. The closure cap apparatus according to claim 1 wherein said container is adapted to dispense substances via an aerosol spray means.

* * * * *